US011680778B2

(12) United States Patent
Fulciniti et al.

(10) Patent No.: US 11,680,778 B2
(45) Date of Patent: Jun. 20, 2023

(54) ELECTRIFIED RIOT PROTECTION SHIELD

(71) Applicants: Sam Fulciniti, Blueridge, GA (US); Janet Fulciniti, Blueridge, GA (US)

(72) Inventors: Sam Fulciniti, Blueridge, GA (US); Janet Fulciniti, Blueridge, GA (US)

( * ) Notice: Subject to any disclaimer, the term of this patent is extended or adjusted under 35 U.S.C. 154(b) by 0 days.

(21) Appl. No.: 17/841,792

(22) Filed: Jun. 16, 2022

(65) Prior Publication Data

US 2022/0404123 A1 Dec. 22, 2022

Related U.S. Application Data

(60) Provisional application No. 63/211,490, filed on Jun. 16, 2021.

(51) Int. Cl.
*F41H 5/08* (2006.01)
*H05C 1/04* (2006.01)

(52) U.S. Cl.
CPC ..... *F41H 5/08* (2013.01); *H05C 1/04* (2013.01)

(58) Field of Classification Search
CPC ..... F41H 5/08; H05C 1/04; H05C 1/06
See application file for complete search history.

(56) References Cited

U.S. PATENT DOCUMENTS 10,619,978 B1 * 4/2020 Ackley ..... F41H 5/02
2008/0007887 A1 * 1/2008 Weaver ..... F41H 13/0018 361/232
2009/0284957 A1 * 11/2009 Shemwell ..... F41H 13/00 362/109

* cited by examiner

*Primary Examiner* — J. Woodrow Eldred
(74) *Attorney, Agent, or Firm* — Brennan, Manna & Diamond, LLC

(57) ABSTRACT

The present invention relates to an electrified riot protection shield for keeping law enforcement officers safe while deterring rioters. The shield is designed as a multi-person shield and can be used by a plurality of security officers to shield their bodies, such that when one or more protestors touch a front surface of the shield, a non-lethal electric shock is administered to the protestor's body to deter the protestor or rioter. The shield can be held in front of the officers' bodies by grasping the insulated handles disposed on a rear surface of the device and an electric supply is provided to a metal plate from an integrated battery for providing the electric shock. A trigger is actuated to enable the electric supply to the metal plate and the trigger can be actuated when the metal plate is pushed or touched by a protestor.

20 Claims, 5 Drawing Sheets

ELECTRIFIED RIOT PROTECTION SHIELD

CROSS-REFERENCE TO RELATED APPLICATION

The present application claims priority to, and the benefit of, U.S. Provisional Application No. 63/211,490, which was filed on Jun. 16, 2021 and is incorporated herein by reference in its entirety.

FIELD OF THE INVENTION

The present invention relates generally to the field of riot protection devices. More specifically, the present invention relates to an electrified riot protection shield for keeping law enforcement officers safe while deterring rioters. The shield can be used by a plurality of security officers to cover or shield their bodies with the shield device, such that when a protestor reaches to touch the front surface of the shield, a non-lethal electric shock is administered to the protestor's body. The shield is held by grabbing insulating handles disposed on a rear surface of the device, and an electric supply is provided to a metal plate for providing the electric shock. A trigger is actuated to enable an electric supply to the metal plate and the trigger can be actuated when the metal plate is pushed or touched by a protestor, or can be manually actuated by the officers. Accordingly, the present disclosure makes specific reference thereto. Nonetheless, it is to be appreciated that aspects of the present invention are also equally applicable to other like applications, devices and methods of manufacture.

BACKGROUND

By way of background, increase in disputes and grievances amongst different sections of society causes individuals in a crowd to engage in violence and/or destruction in the streets or other public spaces. The violent crowd, if not stopped, may ultimately vandalize and damage public property, which can cause large losses to the government and individuals as well. In such riot-like situations, it is the law enforcement officers who have to deal with a rioting crowd in order to prevent them from damaging public property.

The law enforcement officers are generally not allowed to use excessive force and violent devices to stop the crowd from engaging in riots. Devices such as tasers, rubber bullets, and others may be used to keep small rioting crowds under control, however, individual tasers, rubber bullets and other methods may not be effective enough to keep a very large rioting crowd in control.

Other riot protection devices such as a riot shield are also known to be used by law enforcement officers against the rioters. The standard riot shield consists of a polycarbonate sheet having two handles secured to the back of it that enables an individual officer to carry the riot shield to provide good protection against attack, either directly or by missiles and projectiles. However, existing riot shields, heretofore known and used by individual law enforcement officers or police, may not be effective in controlling a large rioting crowd.

With minimal devices available for riot protection, law enforcement officers may have difficulty in keeping a crowd under control. Additionally, with existing riot protection devices that are designed to be used by individual law enforcement officers, it is extremely difficult to control a large rioting crowd. Out of control rioters may need to be dealt with by force, and individual officers may fail to properly contain or control a person with existing riot protection devices.

Therefore, there exists a long felt need in the art for a device that enables the law enforcement officers or police to easily control large rioting crowds. There is also a long felt need in the art for a device that prevents the rioting crowd from damaging public spaces, and prevents any loss to government or individuals. Additionally, there is a long felt need in the art for a riot protection device that is effective in controlling riot-causing crowds. Moreover, there is a long felt need in the art for a riot protection device that can be used together by multiple law enforcement officers. Further, there is a long felt need in the art for a riot protection device that is capable of deterring out of control individuals during a riot. Furthermore, there is a long felt need in the art for a riot protection device that offers a more effective method of riot control. Finally, there is a long felt need in the art for a riot protection device that ensures the safety of law enforcement officers while deterring rioters.

The subject matter disclosed and claimed herein, in one embodiment thereof, comprises a protective riot control and dispersing device. The protective riot control and dispersing device is designed to be deployed as a multi-person shield to protect the security officers from protestors, or a mob while dispersing the rioters or mob. The shield device features a rectangular body with curved side surfaces and includes a front surface and a rear surface. The device can be held by a plurality of security officers such that the front surface faces the protestors, and the rear surface faces the officers. The rear surface includes six insulated handles disposed in three pairs of two insulated handles, wherein each pair can be held by an official/officer. The shield can be supported by a plurality of offices (i.e. three officers) for providing protection there behind. The rear surface can also include a high voltage battery, an ON/OFF control button and a trigger. The front surface can include a metal plate connected to a rigid structured fiberglass plastic. The metal plate selectively receives electrical supply from the high voltage battery upon actuation of the trigger wherein the actuation of the trigger can take place when the metal plate or the plastic is pushed or touched by a protestor. The metal plate, upon receiving electricity from the battery, administers a non-lethal electric shock to the protestor pushing the metal plate and/or plastic.

In this manner, the protective and dispersing device of the present invention accomplishes all of the forgoing objectives and provides law enforcement and riot control officers with an electrified riot control shield capable of deterring out of control individuals during a riot. The device offers a more protective method of riot control, keeping law enforcement officers safe while deterring rioters. In one potential embodiment, a trio of law enforcement officers can grab insulated handles and triggers to support the shield across their bodies to provide a non-lethal electric shock to an uncontrollable protestor who touches the shield device.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a protective riot control shield device. The protective riot control shield device is configured to act as a multi-person shield from protestors or a mob for law enforcement officials, security personnel, and other uniformed security officers. The shield device further comprising a rectangular body with curved side surfaces, having a front surface and a rear surface, wherein the shield is positioned such that the front surface faces the protestors, and the rear surface faces the officials. The rear surface, in one illustrative example, includes six insulated handles disposed in three pairs of two insulated handles wherein each pair is held by an official, and therefore three officials can be protected by the shield. The rear surface further includes a high voltage battery, an ON/OFF control button, and a trigger. The front surface can include a metal plate connected to a rigid structured fiberglass plastic. The metal plate can include electrodes that selectively receive electricity from the high-voltage battery upon actuation of the trigger, wherein the actuation of the trigger can take place when the metal plate or the plastic is pushed or touched by a protestor. The metal plate, upon receiving electricity from the battery, administers a non-lethal electric shock to the protestor pushing the metal plate and/or plastic.

In yet another embodiment, law enforcement officials holding the shield device using the insulated handles do not feel the shock.

In accordance with another feature of the present invention, the ON/OFF control button can be in the ON state for the trigger to be actuated and the ON/OFF control button can be an unbiased switch that remains indefinitely in whichever state it is placed.

In yet another embodiment of the present invention, the trigger can be manually actuated by law enforcement officials holding the shield device for dispersing the mob.

In yet another embodiment of the present invention, a police shield electrified crowd-dispersing apparatus is disclosed. The police shield electrified crowd-dispersing apparatus is designed to allow a trio of law enforcement officers to grab insulated handles and triggers to support the shield across their bodies for protection from protestors while dispersing the crowd/mob. The apparatus includes a metal plate connected to a fiberglass plastic, six insulated handles in three pairs with each pair having two adjacent insulated handles, a high-powered battery for providing electrical supply to the metal plate, a trigger configured to selectively allow supply of electricity from the battery to the metal plate upon actuation, and an ON/OFF switch for activating or deactivating the apparatus wherein the metal plate administers a non-lethal electric shock to at least one protestor who touches or pushes the metal plate using the electrical supply received from the battery.

In yet another embodiment of the present invention, the electric shock effect provided to the at least one protestor, causing a physical deterrent to the protestors, and a mental deterrent to other protestors by producing a psychology of fear for dispersing and running away.

In yet another embodiment, a protective apparatus for dispersing a mob is disclosed. The apparatus can include a generally 8'×3' rectangular frame having curved side surfaces, a front surface, and a rear surface. The front surface faces the mob and the rear surface faces the security personnel in a deployed position. The front surface can include a metal plate with a plurality of metal electrodes for producing an electric shock, the rear surface can include six insulating handles that are held by three security personnel for deploying the apparatus. The metal plate receives an electrical supply from a built-in high voltage battery for administering the electric shock when a trigger is actuated either by the security personnel or automatically when the metal plate is pushed or touched by a protestor.

In yet another embodiment, the trigger can be positioned between, or proximal to, one of the six handles on the rear surface of the apparatus.

In one potential embodiment, the metal plate administers a non-lethal electric shock in the range of 14 KV-18 KV voltage to one or more protestors touching or pushing the shield device or apparatus.

An advantage of the protective shield device of the present invention is that it provides law enforcement and riot control officers with an electrified riot control shield, capable of deterring out of control individuals during a riot, and provides protection to a plurality of officers simultaneously. Further, the device is lightweight and can be held for extended periods of time. The shield device also protects the officers from the impact of stones or sticks and from the threat of acid or any other incendiary liquid.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
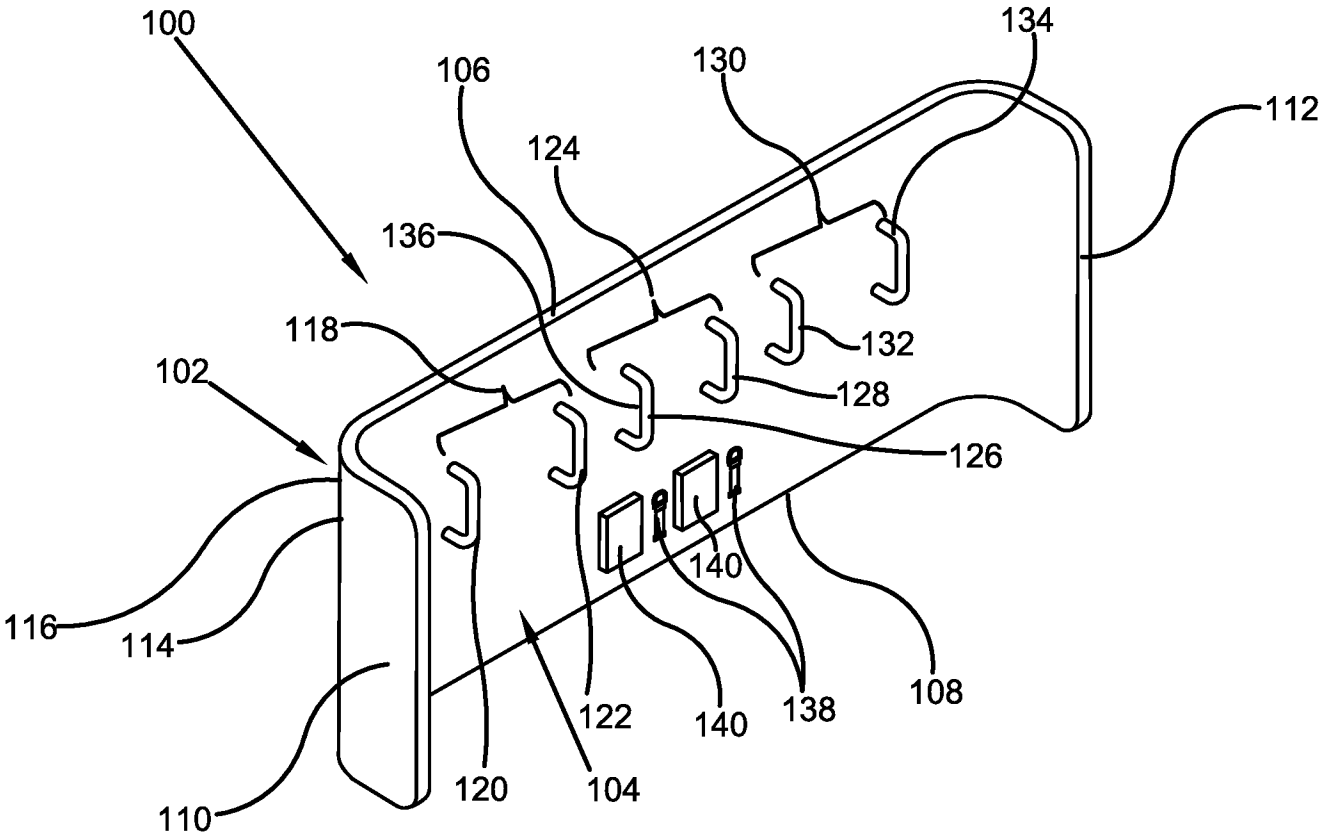
FIG. 1 illustrates a perspective view of one potential embodiment of a protective riot control shield of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device that enables the law enforcement officers or police to easily control large rioting crowds. There is also a long felt need in the art for a device that prevents the rioting crowd from damaging public spaces and prevents any loss to the government or individuals. Additionally, there is a long felt need in the art for a riot protection device that is effective in controlling riot-causing crowds. Moreover, there is a long felt need in the art for a riot protection device that can be used together by multiple law enforcement officers. Further, there is a long felt need in the art for a riot protection device that is capable of deterring out-of-control individuals during a riot. Furthermore, there is a long felt need in the art for a riot protection device that offers a more effective method of riot control. Finally, there is a long felt need in the art for a riot protection device that ensures the safety of law enforcement officers while deterring rioters.

The present invention, in one exemplary embodiment, includes a novel police shield electrified crowd-dispersing apparatus. The police shield electrified crowd dispersing apparatus can be deployed by a plurality (i.e. three) of law enforcement officers by holding six insulated handles and triggers to support the shield across their bodies for protection from protestors and for dispersing of the mob. The apparatus includes a metal plate connected to a fiberglass plastic, six insulated handles in three pairs with each pair having two adjacent insulated handles, a high-powered battery for providing an electrical supply to the metal plate, a trigger configured to allow a supply of electricity from the battery to the metal plate upon actuation, an ON/OFF switch for activating or deactivating the apparatus, wherein the metal plate administers a non-lethal electric shock to at least one protestor who touches or pushes the metal plate using the electrical supply received from the battery.

Figure 2:
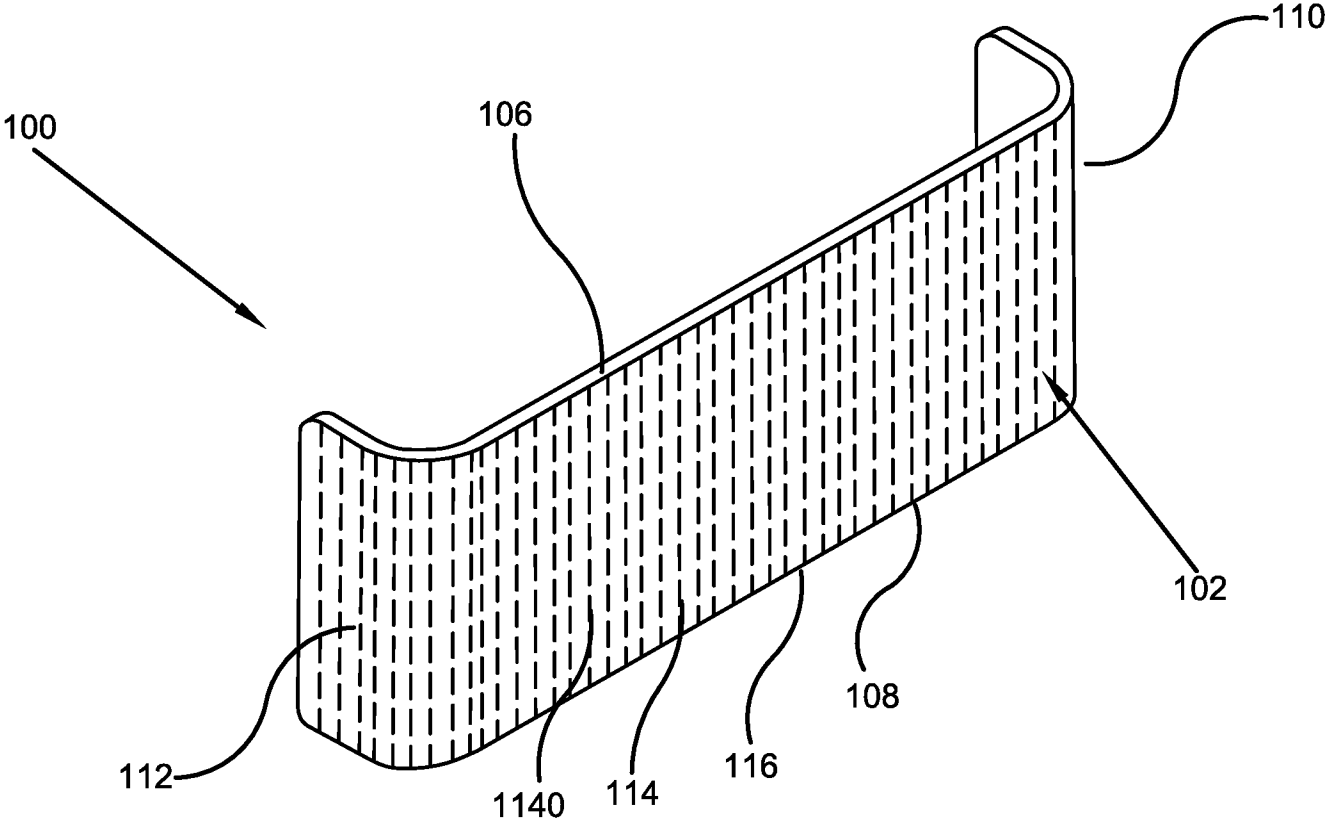
FIG. 2 illustrates a front perspective view of one potential embodiment of the protestor dispersing shield device of the present invention in accordance with the disclosed architecture.

Referring initially to the drawings, FIG. 1 illustrates a perspective view of one potential embodiment of a protective riot control shield 100 of the present invention in accordance with the disclosed architecture. The protective riot control shield 100 of the present invention is designed to be used by a plurality of law enforcement officials simultaneously for deterring out of control individuals during a riot. The shield device 100 is a protective device for officials, patrolling officers, uniform security guards, and others, and protects them from uncontrollable individuals in riots. The shield device 100 includes a generally rectangular shield having a front surface 102 and a rear surface 104. The shield device 100 has a top edge 106, a bottom edge 108, and two curved side surfaces 110,112. The curved surfaces 110,112 form a C-shape towards the rear surface 104. The front surface 102 includes a selectively-electrified metal plate 114 along the complete surface and is superimposed by a hard-structured fiberglass plastic 116 as best shown in FIG. 2. The rear surface 104 of the shield device 100 includes three pairs of insulated handles that are positioned and configured to be held by three law enforcement officials. As shown, a first pair 118 of insulated handles includes a first handle 120 and a second handle 122, and are positioned near the first curved surface 110. A first of three officials can hold the first pair of insulated handles 118. Adjacent to the first pair 118 of insulated handles, a second pair 124 of insulated handles, including a first handle 126 and a second handle 128, are positioned on the rear surface 104. The second pair 124 can be held by a second of three officials for security purposes. A third pair 130 of the insulated handles including a first handle 132 and a second handle 134 are positioned adjacent to the second pair 124, and can be held by the third law official. The shield device 100 is lightweight and sturdy, and can be held by three officials for an extended period of time for their protection. The shield device 100 is generally 8' in length from the first curved surface 110 to the second curved surface 112, and is generally 3' in height from the top edge 106 to the bottom edge 108, thereby allowing the three officials to be properly covered and protected by the device 100.

The device 100 uses the metal plate 114 disposed on the front surface 102 for providing an electric shock to a person coming close to the law enforcement officials. The electric shock is generated when a person pushes or touches the front surface 102 with slight force, thus actuating a trigger 136 disposed between the one or both handles 126, 128 and the rear surface 104. When the front surface 102 is pushed by one or more unruly individuals with slight force, the plastic layer 116 is pushed towards the rear surface 104 to actuate the trigger 136. For activating the trigger, an ON/OFF control button or switch 138 positioned on the rear surface 104 should be in an ON position and as the trigger 136 is actuated, electric supply from the built-in batteries 140 is supplied to the metal plate 114. The metal plate 114 is configured to provide electric shock when an electric supply is received from the batteries 140, and thus deters the uncontrollable individuals. The electric shock is automatically administered upon pressing the front surface 102 when the ON/OFF control button 138 is activated and the trigger 136 is actuated. The law enforcement officials holding the shield 100 using the insulated handles remain unaffected from the electronic shock, and thus are able to deter the rioters and protect themselves.

The protective shield 100 is designed to offer protection from violent protestors. The shield 100 is preferably opaque and distortion-free, allowing the security officials to always remain behind the shield 100. The insulated handles 120, 122, 126, 128, 132, 134 are integrated to the rear surface 104, and the batteries 140 can be replaced with new batteries as per requirements. Further, the batteries 140 and the metal plate 114 are connected to each other through an interior wired circuit (not shown) for providing electrical supply from the batteries 140 to the metal plate 114.

FIG. 2 illustrates a front perspective view of the protestor dispersing shield device 100 of the present invention in accordance with the disclosed architecture. The front surface 102 of the shield device 100 is a smooth, rigid, and sturdy surface. The front surface 102 is formed of a selectively-electrified metal plate 114 that is hardwired to the power supply or battery disposed at the rear surface 104 of the device 100. The metal plate 114 can have metal electrodes 1140 and is covered by a hard structured fiberglass plastic 116 that upon being pressed by protestors or rioters actuates the trigger 136 (shown in FIG. 1) disposed on the rear surface 104. This actuation automatically supplies an electrical power from the built-in batteries to the metal plate to create an electric shock to the protestors or rioters touching the metal plate 114. This causes the protestors or rioters to disperse and move away from the shield device 100, and thus is useful for protecting the security officials holding the device 100 as shown in FIG. 3.

The metal plate 114 uses the DC supply of the built-in batteries for providing electric shock to the rioters touching the front surface 102. When a protestor presses the metal plate 114 or fiberglass plastic 116, a high-pressure electric shock is administered automatically by actuating the trigger and an electric shock effect is provided to a human body, causing the protestors to recoil from the shield 100 and deterring others from approaching the shield 100. The metal plate 114 and the plastic 116 extend across the complete front surface 102 from the top edge 106 to the bottom edge 108 and between the side surfaces 110, 112 of the shield 100.

Figure 3:
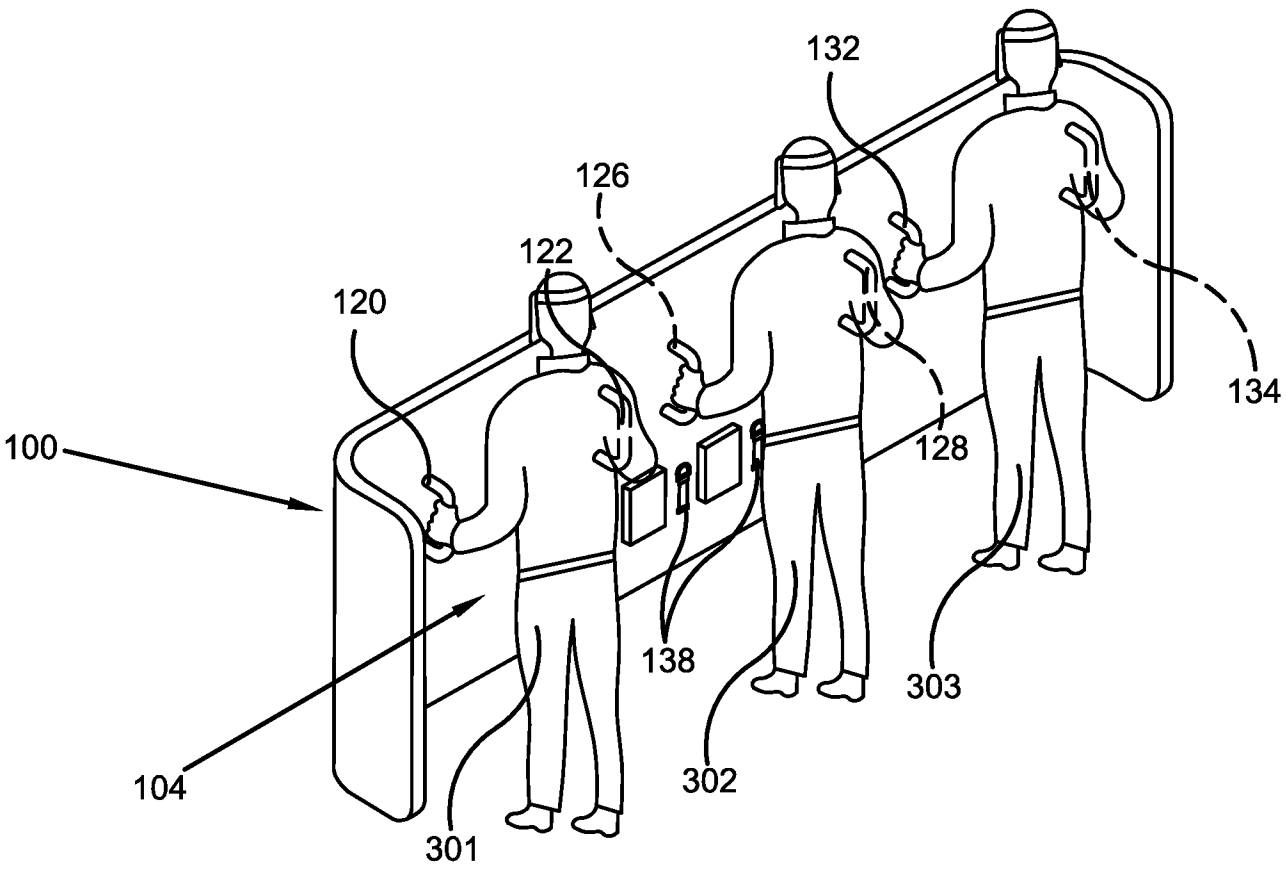
FIG. 3 illustrates a rear perspective view of three law enforcement officials holding one potential embodiment of the rioter dispersing shield device of the present invention in accordance with the disclosed architecture.

FIG. 3 illustrates a rear perspective view of three law enforcement officials holding the rioter dispersing shield device 100 of the present invention disposed in accordance with the disclosed architecture. As shown, the shield device 100 of the present invention can be used by three security officials 301, 302, 303 in unison. Therefore, the shield 100 protects and shields the officials 301, 302, 303 simultaneously while dispersing rioters and protestors. The shield 100 is held by the first official 301 using the insulated handles 120, 122. Similarly, the second official 302 holds the shield 100 using the insulated handles 126, 128, and the third official 303 holds the shield 100 using the insulated handles 132, 134. The position of the shield 100 can be adjusted to cover a desired body part by the security personnel 301, 302, 303. It should be appreciated that the ON/OFF control 138 is under the control of the officials 301, 302, 303, and can be activated on demand whenever the riot is getting uncontrollable or the officials are being threatened. The insulated handles and the insulated rear surface 104 do not pose any electrical threat to the officials, and thus shield and protect them. The shock-proof rubber handles held by the officials keep the officers 301, 302, 303 safe while administering the shock to control the rioters.

Figure 4:
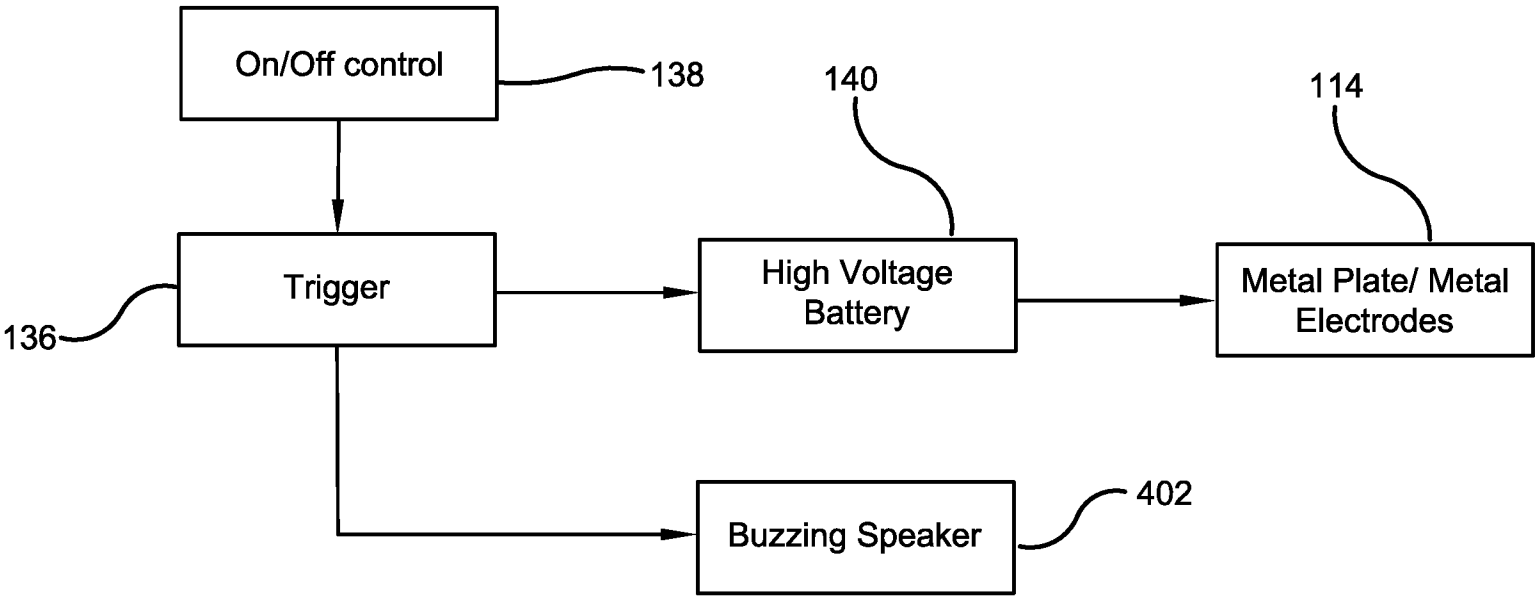
FIG. 4 illustrates a block diagram showing the exemplary connections between various electronic components of one potential embodiment of the multi-person shield device of the present invention in accordance with the disclosed architecture.

FIG. 4 illustrates a block diagram showing the exemplary connections between various electronic components of the multi-person shield device 100 of the present invention in accordance with the disclosed architecture. It should be noted that all the components that are used for administering an electric shock are hardwired within the shield device 100. Waterproof electrical circuitry is used for connecting the components. The trigger 136, when actuated, activates the high voltage battery 140 disposed in the rear surface of the device 100. Further, the trigger 136 also closes the hardwired circuit between the battery 140 and the metal plate having electrodes 1140, thereby allowing electricity to flow from the battery 140 to the metal plate 114. The trigger 136 can be actuated when the ON/OFF control button 138 is positioned in an ON state. The trigger 136 is preferably actuated when the plastic sheet disposed on the front surface of the device 100 is pushed by a protestor. Alternatively, the trigger 136 can be actuated manually by security personnel holding the shield 100. The ON/OFF control button 138 can be a typical unbiased switch that remains indefinitely in whichever state it is placed. If a security personnel pushes the ON/OFF control button 138 to the on (or closed) state, for example, the control button 138 will remain in the on state until the security personnel push the switch 138 to the off (or open) state. The ON/OFF control button 138 may include any manual or electronic switches or actuators known in the art. The ON/OFF control button 138, when activated, can also actuate an optional buzzing speaker 402 for alerting the protestors (i.e. providing an audible warning) about the possible electrical shock that can be experienced by the shield device 100. Using the battery 140, the shield 100 is able to provide a non-lethal shock in the range of 14 KV-18 KV voltage. The metal plate is preferably made of lightweight aluminum strips.

The high voltage battery 140 is replaceable and rechargeable. Further, the battery 140 can be protected by a battery cover and can have a low battery indicator, indicating to the security official to recharge the battery 140. The high voltage battery 140 can include any battery or cell known in the field, including general purpose batteries, lithium-ion batteries, nickel-cadmium batteries, alkaline batteries, nickel metal hydride batteries, lead acid batteries, rechargeable batteries or any other batteries. Preferably, the battery 140 is a 5200 milli-amp battery.

Figure 5:
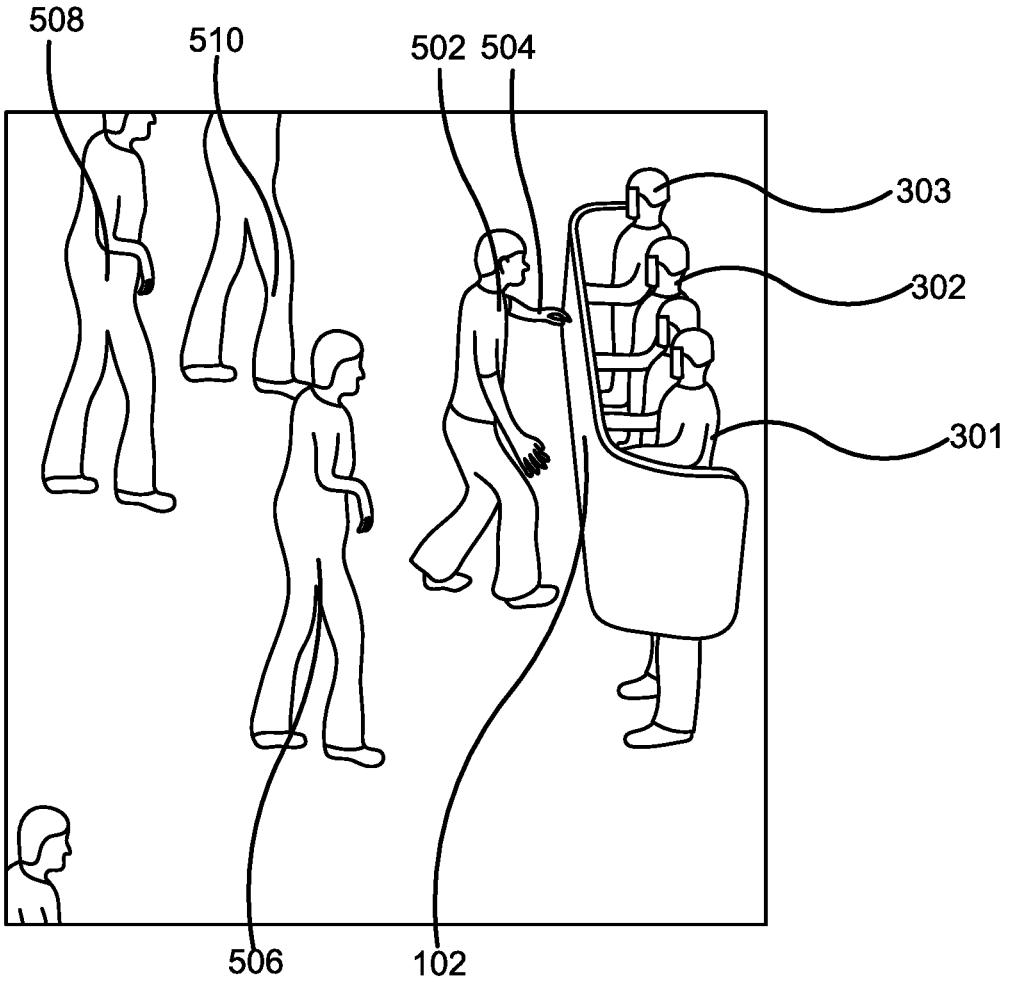
FIG. 5 illustrates a perspective view showing a protestor receiving an electric shock when the front surface of one potential embodiment of the police shield electrified crowd disperser is pushed or touched in accordance with the disclosed architecture.

FIG. 5 illustrates a perspective view showing a protestor experiencing an electric shock when the front surface 102 of the police shield electrified crowd disperser 100 is pushed or touched in accordance with the disclosed architecture. As shown, three law enforcement officials 301, 302, 303 hold the dispersing device 100 to protect themselves by dispersing the mob whenever the mob tries to overpower the officials. Whenever a protestor, shown as an exemplary protestor 502, pushes or contacts with minimal force the front surface 102 having the metal plate 114 and the plastic sheet 116, the trigger is actuated as described earlier in the disclosure. This enables electricity to be supplied from the battery to the metal plate 114 that includes electrodes 1140 for administering a non-lethal electric shock to the protestor 502. When the protestor 502 gets the electric shock, it is understood that other protestors such as 506, 508, 510 develop a psychology of fear and are deterred from coming any closer to the shield 100. In this manner, the mob is dispersed and the officers 301, 302, 303 are protected.

It should be appreciated that the police shield, electrified crowd-dispersing or shield device 100 is a protective device for a plurality of law enforcement officials. Preferably, three officials can hold the shield 100 and be able to disperse the mob and be protected from same. However, the shield device 100 can be designed to be held by four security officials or five security officials, et. al. The shield device 100 also protects the officials from impact of stones or sticks and from the threat of acid or any other incendiary liquid.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "police shield electrified crowd disperser", "protective riot control shield", "protestor-dispersing shield device", "rioter dispersing shield device", "shield device", "protective shield", "shield" and "device", are interchangeable and refer to the protective riot control shield 100 of the present invention.

Notwithstanding the forgoing, the protective riot control shield 100 of the present invention can be of any suitable size and configuration as is known in the art without affecting the overall concept of the invention, provided that it accomplishes the above-stated objectives. One of ordinary skill in the art will appreciate that the size, configuration and material of the protective riot control shield 100 as shown in the FIGS. are for illustrative purposes only, and that many other sizes and shapes of the protective riot control shield 100 are well within the scope of the present disclosure. Although the dimensions of the protective riot control shield 100 are important design parameters for user convenience, the protective riot control shield 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A protective riot control shield for deterring an individual, the protective riot control shield comprising:

a shield having a generally rectangular shape, a front surface and a rear surface;

wherein said shield includes a top edge, a bottom edge, and a pair of curved side surfaces;

wherein said rear surface includes a plurality of insulated handles configured to be held by a plurality of law enforcement officials;

wherein said front surface includes a selectively electrified metal plate for providing an electric current to the individual contacting said front surface; and a trigger mounted in said shield, wherein said trigger is actuated when said front surface is contacted by the individual.

2. The protective riot control shield of claim 1, wherein said plurality of insulated handles comprises three pairs of handles.

3. The protective riot control shield of claim 2, wherein said shield comprises a length of generally eight feet and a height of generally three feet.

4. The protective riot control shield of claim 3, wherein said plurality of law enforcement officials is three law enforcement officials.

5. The protective riot control shield of claim 2 further comprising an ON/OFF switch for activating and deactivating said trigger.

6. The protective riot control shield of claim 5 further comprising a battery for supplying the electric current to said selectively electrified metal plate.

7. The protective riot control shield of claim 6, wherein said battery is rechargeable.

8. The protective riot control shield of claim 7, wherein said electric current is in a range of 14 KV-18 KV volts.

9. A protective riot control shield for deterring an individual, the protective riot control shield comprising:

a shield having a front surface, a rear surface, a top edge, a bottom edge and a pair of side surfaces, wherein said rear surface comprises a plurality of insulated handles configured to be held by a plurality of law enforcement officials, and further wherein said front surface comprises a metal plate for providing an electric current to the individual contacting said front surface;

a trigger mounted in said shield; and an ON/OFF switch for activating and deactivating said trigger, wherein said trigger is actuated when said front surface is contacted by the individual.

10. The protective riot control shield of claim 9, wherein said plurality of insulated handles comprises three pairs of handles.

11. The protective riot control shield of claim 10, wherein said shield comprises a length of generally eight feet and a height of generally three feet.

12. The protective riot control shield of claim 11, wherein said plurality of law enforcement officials is three law enforcement officials.

13. The protective riot control shield of claim 12 further comprising a battery for supplying the power to said metal plate.

14. The protective riot control shield of claim 13, wherein said battery is rechargeable.

15. The protective riot control shield of claim 9, wherein said electric current is in a range of 14 KV-18 KV volts.

16. A protective riot control shield for deterring an individual, the protective riot control shield comprising:

a shield comprising a front surface, a rear surface, a top edge, a bottom edge and a pair of side surfaces, wherein said rear surface comprises a plurality of insulated handles configured to be held by a plurality of law enforcement officials, and further wherein said front surface comprises a selectively electrified metal plate for providing an electric current to the individual contacting said front surface;

a trigger mounted to said shield; and an ON/OFF switch for activating and deactivating said trigger, wherein said trigger is actuated when said front surface is contacted by the individual, and further wherein the electric current is in a range of 14 KV-18 KV volts.

17. The protective riot control shield of claim 16, wherein said plurality of insulated handles comprises three pairs of handles.

18. The protective riot control shield of claim 17, wherein said plurality of law enforcement officials is three law enforcement officials.

19. The protective riot control shield of claim 18 further comprising a battery for supplying the electric current to said selectively electrified metal plate.

20. The protective riot control shield of claim 19, wherein said battery is rechargeable.

* * * * *